United States Patent [19]

Livingston et al.

[11] 4,312,617

[45] Jan. 26, 1982

[54] CASE BLANK VACUUM PICKUP AND FEEDER APPARATUS

[75] Inventors: Ralph H. Livingston, Excelsior; Philip G. Rawlins, Minneapolis, both of Minn.

[73] Assignee: Bemis Company, Inc., Minneapolis, Minn.

[21] Appl. No.: 54,693

[22] Filed: Jul. 5, 1979

[51] Int. Cl.[3] ..... B65H 3/08

[52] U.S. Cl. ..... 414/121; 271/104

[58] Field of Search ..... 414/113, 120, 121, 122; 271/12, 104, 107; 198/744, 721

[56] References Cited

U.S. PATENT DOCUMENTS

| | | | |
|---|---|---|---|
| 3,261,449 | 7/1966 | Mackay et al. | 198/744 |
| 3,879,031 | 4/1975 | Melehan | 271/104 X |
| 3,933,255 | 1/1976 | Lieder et al. | 271/104 UX |
| 4,133,254 | 1/1979 | Odom et al. | 93/535 D |
| 4,189,136 | 2/1980 | Robinette | 271/12 |

*Primary Examiner*—Stanley H. Tollberg

*Attorney, Agent, or Firm*—Clayton R. Johnson

[57] ABSTRACT

Case blank magazine and feeder apparatus for picking up a case blank from a stack of case blanks on the magazine and feeding the blank into the case opening part of the machine, a pickup carriage mounted on a frame for reciprocal movement from a blank pickup position to a blank transfer position, vacuum cups mounted on pickup carriage for movement between a lowered pickup position and an elevated position, a belt conveyor assembly on the frame for advancing the picked up blank from the transfer position to a discharge position that the blank falls onto slide rails, a carriage mounted on the frame for reciprocal movement for advancing the blank to a blank opening station and control mechanism for vacuum cups and the pickup carriage.

15 Claims, 7 Drawing Figures

FIG. 1A
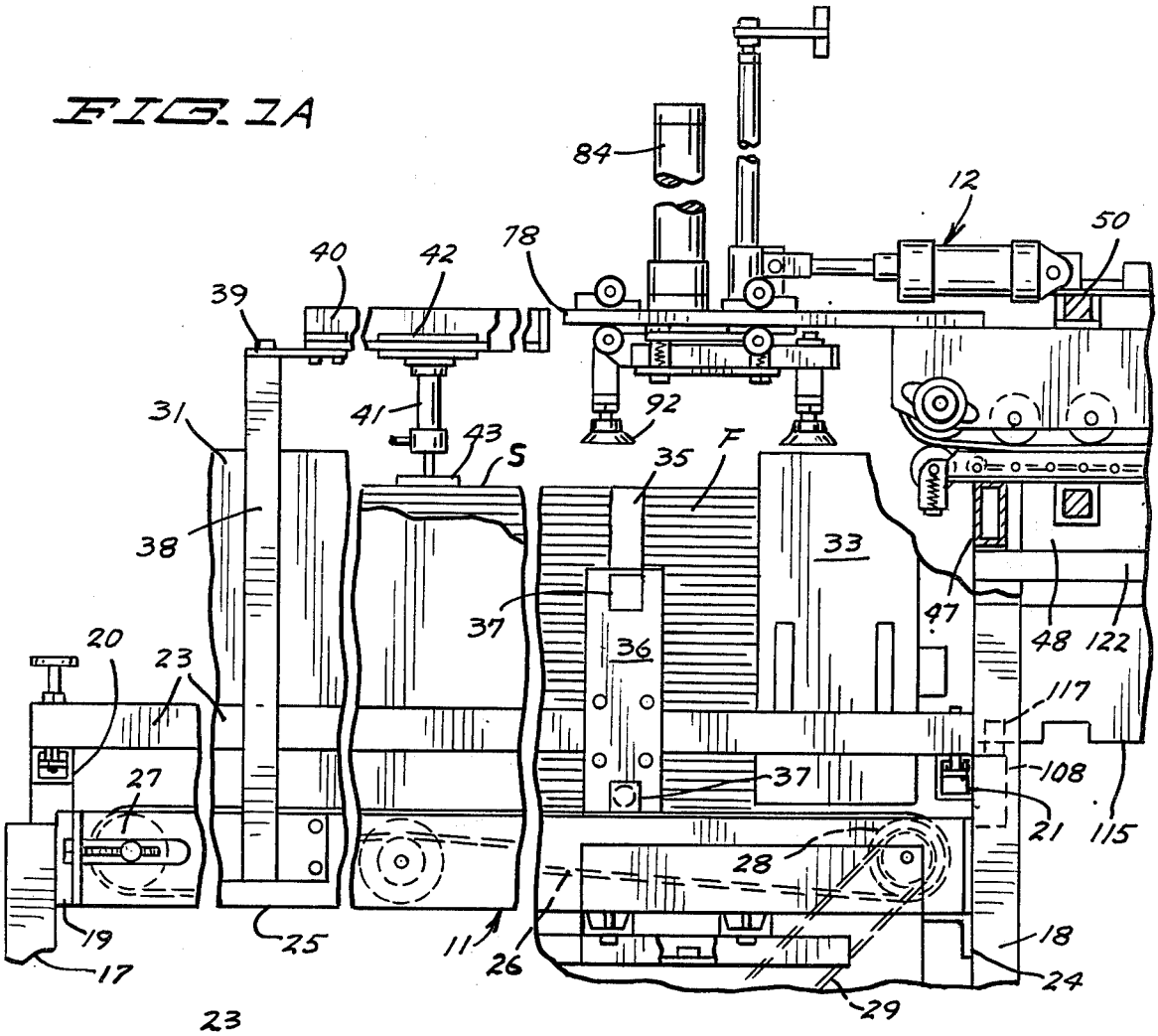
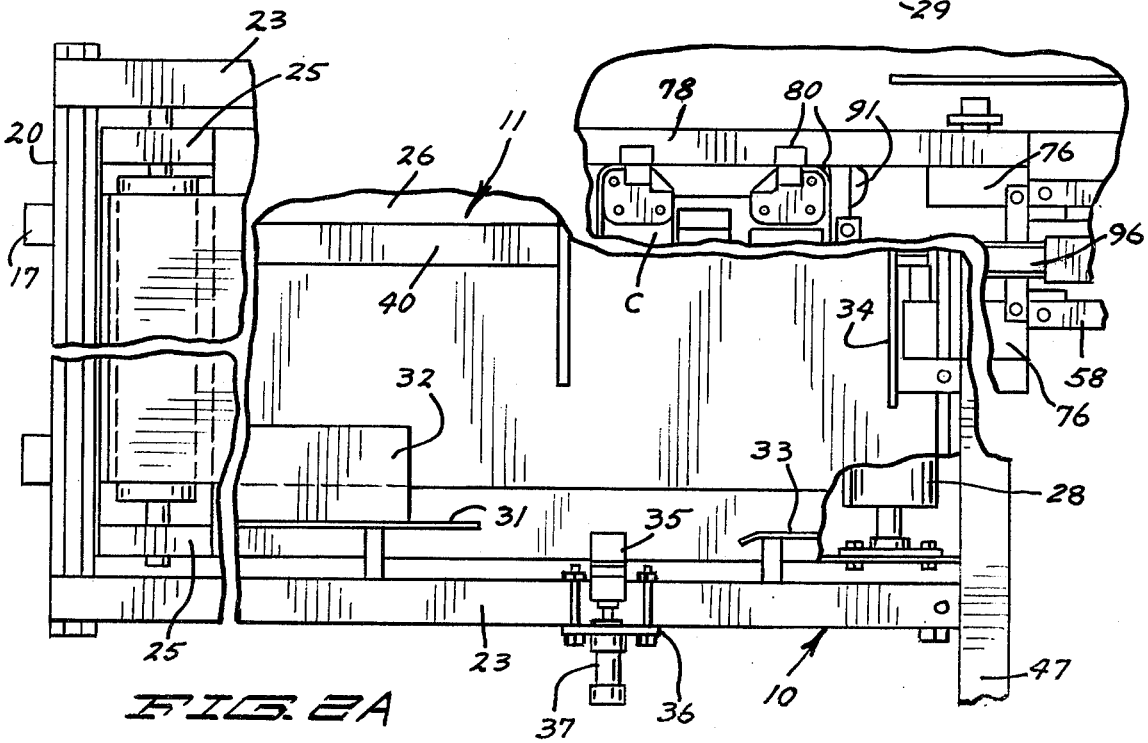
FIG. 2A

CASE BLANK VACUUM PICKUP AND FEEDER APPARATUS

BACKGROUND OF THE INVENTION

Case blank vacuum pickup and feeder apparatus for removing a case blank from a vertical stack of unopened, horizontal, flat folded case blanks and advancing the case blank to a location to have another work operation performed thereon.

In U.S. Pat. No. 4,133,254 to Odom et al there is disclosed a case opening and bottom sealing machine that includes vertically reciprocated vacuum cups for elevating the uppermost case blank from a first vertical stack of blanks on a magazine and hold down mechanism for abutting against the top blank on an adjacent second stack. In U.S. Pat. No. 3,933,255 to Lieder et al there is disclosed reciprocated carriage mechanism for stripping a case blank from the bottom of a stack of blanks and moving the stripped blank along slide rails to other mechanism to have folding and other operations carried out to form a box or container.

In order to make improvements for removing a flat folded case blank from a stack of case blanks and moving the case blanks to a location to have other operations performed thereon, this invention has been made.

SUMMARY OF THE INVENTION

Apparatus for removing a folded case blank from a magazine and moving the folded blank to a location to have other operations performed thereon that includes a belt conveyor assembly for receiving a flat folded case blank, advancing the folded case blank, and then discharging the blank, a case blank pusher carriage for pushing the discharged case blank along slide rails and a vacuum case blank pickup assembly for removing a case blank from the magazine, advancing the picked up case and feeding the picked up case to the belt conveyor assembly.

One of the objects of this invention is to provide new and novel means for removing a single case blank at a time from a stack of flat folded case blanks and feeding the case blank to a case blank opening and forming position of a machine. Another object of this invention is to provide new and novel means for removing a flat folded case blank from a stack of case blanks and moving the case blank to a position for being fed by a reciprocating case blank pusher carriage to have other work operations carried out on the case blank.

A further object of the invention is to provide new and novel belt conveyor means for receiving a folded case blank that has been removed from a stack of blanks and advancing the blank to another location. Another object of this invention is to provide new and novel means for abutting against opposite sides of a stack of case blanks from which one blank at a time is removed to aid in separating the blank being removed from the adjacent blanks in the stack.

BRIEF DESCRIPTION OF THE DRAWINGS

FIGS. 1A and 1B when taken together are a fragmentary side elevational view of the apparatus of this invention, various parts being broken away to illustrate other parts of the apparatus;

FIGS. 2A and 2B when taken together are a fragmentary plan view of the apparatus of this invention, various transverse and longitudinal intermediate portions being broken away, and various parts only being partially shown in order to illustrate other parts;

Figure 2B:
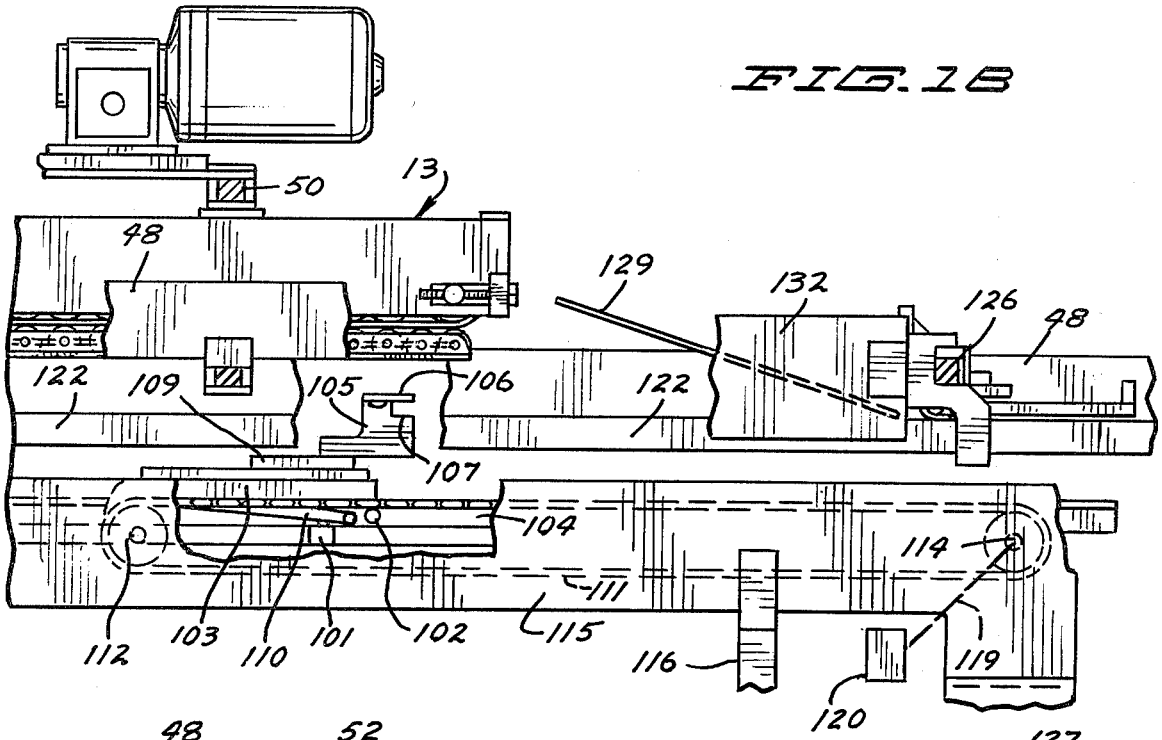
Figure 2B:
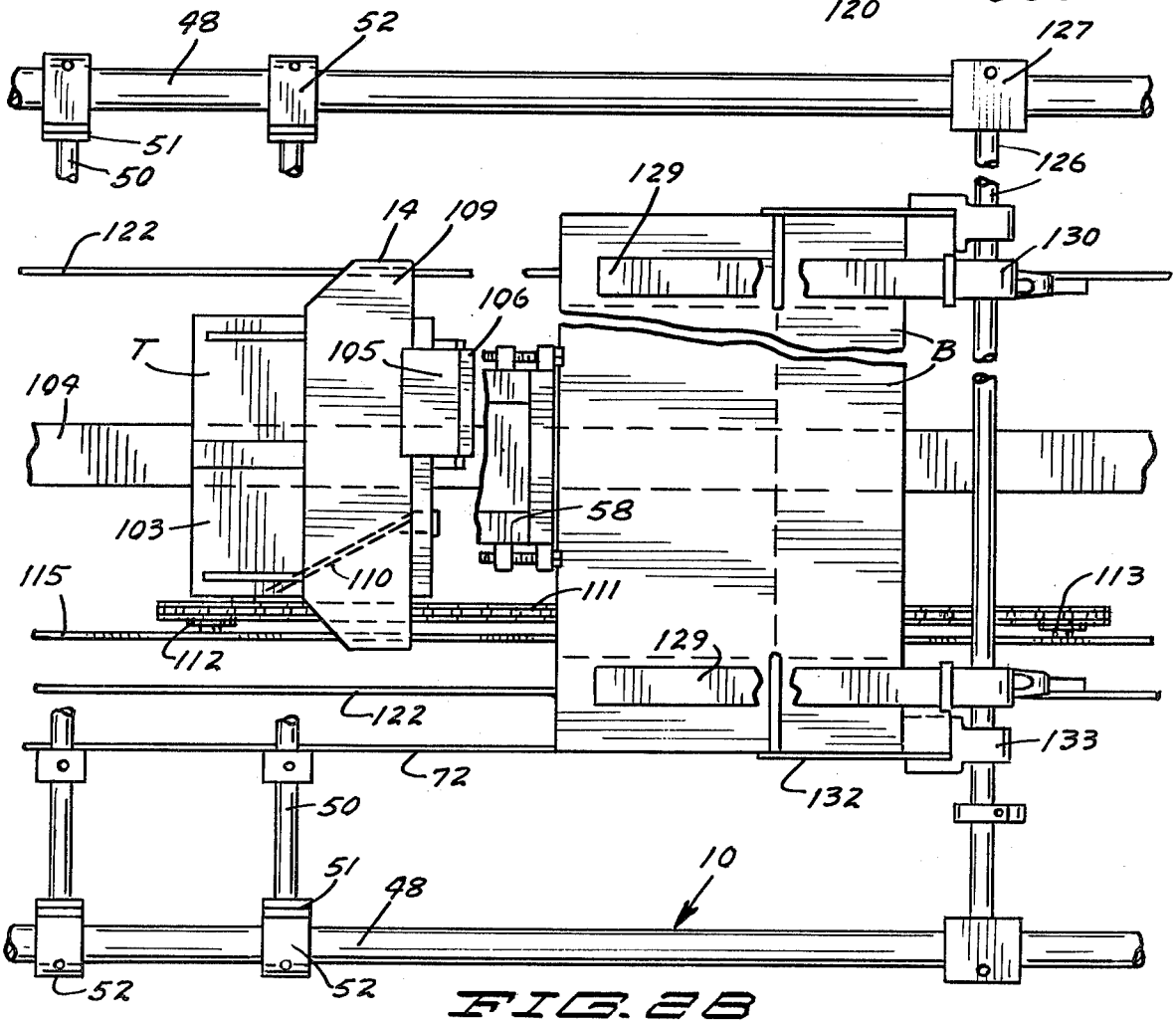
Figure 3:
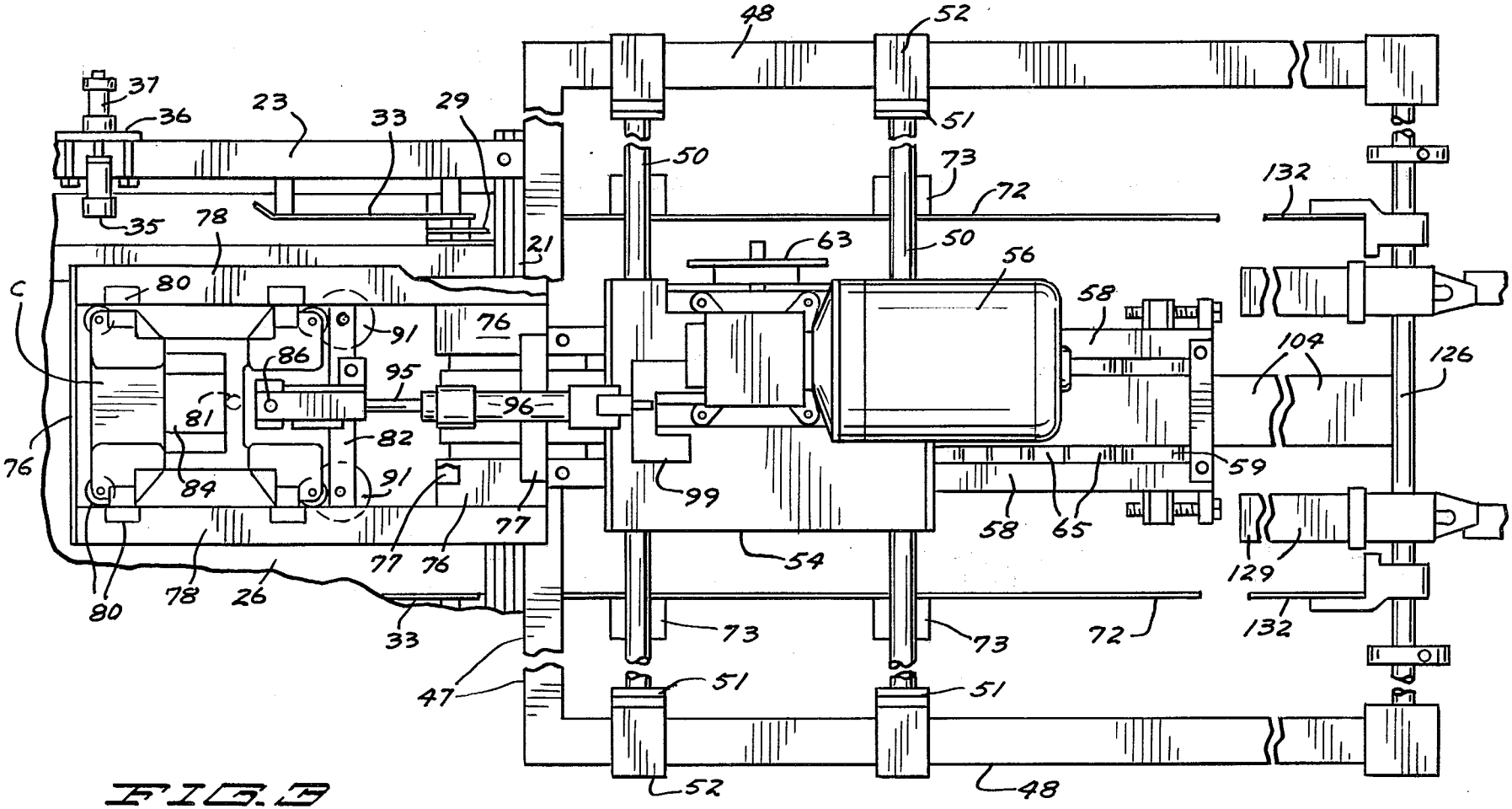
FIG. 3 is an enlarged fragmentary plan view of the vacuum pickup and trolley feed assemblies, various transverse and longitudinal intermediate portions being broken away.

Referring now in particular to FIGS. 1A, 1B, 2A, and 2B, the apparatus of this invention includes a main frame 10, a magazine assembly 11, a vacuum pickup assembly 12, a belt conveyor assembly 13, and a trolley feed assembly 14, each being generally designated. The frame includes rear uprights 17, intermediate uprights 18, a transverse frame member 19 mounted by the upper ends of uprights 17, a transverse channel 20 having frame members dependingly secured thereto that are in turn mounted by frame member 19, a transverse frame member 24 that is mounted by uprights 18, and a front channel 21 that is mounted by uprights 18 at a higher elevation than frame member 24. A pair of longitudinal frame members 23 extend between channels 20, 21 and have their opposite ends clampingly secured to the adjacent channel by suitable clamp mechanism to permit selectively adjustable transverse spacing of the frame members 23 and retaining the frame members 23 in their adjusted positions.

The magazine assembly 11 includes an open rectangular magazine frame that has its opposite ends mounted by frame members 19 and 24. The magazine frame includes longitudinal magazine frame members 25 that at their rearward ends mount an idler roller 27 and at their forward ends mount a driven roller 28. An endless belt 26 is extended around roller 27 and roller 28 to be driven thereby, a drive connection 29 extending between the driven roller and a reducer-motor combination 147 (see FIG. 5) that is mounted on the frame.

In order to aid in retaining vertical stacks of horizontal, folded case blanks in proper stacked relationship as they are moved forwardly by the belt 26, there is provided vertical, side rear guide plates 31 that are mounted by the respective frame member 23. One of the guide plates 31 at its upper edge mounts a top guide plate 32 to extend into overhanging relationship to the belt 26, the front and rearward end portions of plate 32 being inclined upwardly and away from the intermediate portion of the plate 32. Also mounted on each of the frame members 23 is a vertical, side front guide plate 33 while longitudinally intermediate each set of plates 31, 33 there is provided a vertically elongated brush 35. Each brush is mounted by the piston rod of a brush cylinder 37. Each brush cylinder 37 is mounted by clamp mechanism 36 that in turn is mounted on the respective frame member 23 to be retained in select adjusted positions along the length thereof. The bristles of the brush extend inwardly toward one another to abut against the front stack of blanks F on the belt for purposes of insuring separation of the uppermost blank from the remainder of the stack as the uppermost blank is elevated from the stack. That is, as the uppermost blank is removed, the vacuum between the uppermost blank and the next one or two lower ones tend to lift them up, particularly as the height of the stack is substantially decreased. Thus the bristles hold down the blanks beneath the uppermost blank, the bristles extending to abut against the entire height of a stack of blanks on belt 26.

In order to prevent the blanks in the stack S that is adjacent the stack F, from being moved out of position, particularly when the two stacks are in abutting relationship, and blanks from stack F are being removed, there is provided blank hold-down mechanism that includes a generally U-shaped support 38. The lower ends of the legs of the U-shaped support are secured to the adjacent frame member 25 with spacers being provided between the legs and the frame members while the webbed portion thereof mounts a plate 39. The rear end of the longitudinal bracket 40 is bolted to the plate 39 while a clamp device 42 is mounted on the bracket to be retained in selected adjusted positions along the longitudinal length thereof. The device 42 dependingly mounts a cylinder 41 of a piston-cylinder combination, the piston rod thereof mounting a clamp pad 43.

The frame also includes a top intermediate transverse frame member 47 that extends between and is secured to the upper ends of the upright 18. The forward ends of the frame members 48 are mounted by uprights (not shown). In order to mount the vacuum pickup and belt conveyor assemblies, there is provided a pair of transverse upper rails 50 which have their one ends joined to the upper ends of vertical plates 51. The lower ends of the vertical plates are joined to clamp mounts 52. Mounts 52 are slidably mounted on the longitudinal frame members 48 and are of a type to clampingly engage the frame members to be retained in selected adjusted positions along the length thereof. Lower transverse rails 53 extend between and are joined to the lower ends of the vertical plates 51. A mounting member 54 is supported by the upper rails 50 while front and rear tie plates extend beneath the rails 50 and are bolted to the mounting member for retaining the mounting member in selected transverse adjusted position on the rails. A motor-reducer 56 is mounted on the mounting member 54.

The belt conveyor assembly 13 includes a pair of longitudinally elongated conveyor side frames 58, an idler roller 59 being mounted on the rear portion of the side frames for limited adjustable longitudinal movement. A driven roller 60 is mounted by the forward end portions of the side frames, an endless belt 61 being extended around rollers 59, 60 to be driven by roller 60. A chain 62 is extended around a sprocket that is keyed to the shaft of the roller 60 and around a sprocket 63 that is keyed to the output shaft of the motor-reducer 56.

A plurality of transverse, longitudinally spaced rollers 65 have the shafts thereof mounted by vertical bolts that are slidably extended through flanges of the side frames, springs 66 being provided on the bolts for resiliently urging the shafts and thereby rollers 65 in a downward direction. The rollers 65 abut against the upper surface of the lower run of the belt 61 longitudinally intermediate rollers 59, 60.

Longitudinally elongated lower side frames 66 are mounted by a pair of transverse cross plates 67 that are supported by the lower rails 53, mounts 68 being bolted to the cross plates for retaining the lower side frames 66 in selected transverse adjusted positions on the rails 53. The front end portions of the lower side frames 66 mount the shaft of a lead roller 65 for limited vertical movement, there being provided spring device 69 for resiliently urging the shaft upwardly to the belt 61 to provide an entry nip. There are provided a plurality of longitudinally spaced, transverse conveyor rollers which have shafts 70 mounted by the lower side frames. Roller 65 resiliently retains the lower surface of the inner run of the belt 61 in abutting relationship with the conveyor rollers 70 and support a folded case blank when it is moved therewith by belt 61.

The vacuum pickup assembly includes a pair of mounting plates 76 and tie bar 77 that are bolted to the upper side frames 68. Each of the mounting plates mounts the rear end portion of a longitudinally extending roller track 78, the tracks extending in overhanging relationship to the magazine belt 26. A tie bar 79 extends between and is bolted to the rear ends of the roller tracks. A carriage C has rollers 80 abutting against the under and upper surfaces of the roller track and adjacent vertical surfaces of the tracks whereby the carriage is longitudinally movable along the roller tracks.

Mounted beneath the carriage is a top floater plate 83, the floater plate being mounted by a piston-cylinder combination that includes a cylinder 84 mounted on a carriage and a piston rod extend through the carriage and secured to the floater plate for vertically reciprocating the floater plate. A guide shaft 86 is also secured to the upper floater plate 83 and is vertically, slidably extended through a guide mount 85 that is mounted on the carriage. A plurality of bolts 87 are mounted by the upper floater plate to dependingly support a lower floater plate 88 while permitting limited vertical movement of the lower floater plate relative the upper plate. Springs 89 are provided on the bolts for resiliently urging the lower floater plate away from the upper floater plate. Extending between the floater plates is a longitudinally elongated channel arm 82, the channel arm dependingly mounting a transversely elongated front vacuum cup mount 90. Advantageously channel arm 82 is rectangular in transverse cross section. Mount 90 dependingly mounts a pair of front vacuum cups 91 for being retained in transversely adjustable spaced relationship to one another. A rear vacuum cup 92 is dependingly mounted by a generally right angular arm (rear vacuum cup mount) 93, the horizontal of leg mount 93 being telescopically extended into channel arm 82 and retained in a longitudinally adjusted position by a suitable adjustment screw (not shown).

A screw (pivot member) 81 is threaded into channel arm 82 to have its generally partially spherical shaped head abut against the under surface of the top floater plate. The pivot screw 81 is generally transversely and longitudinally centered relative bolts 87, there being provided a pair of longitudinally spaced bolts 87 on each transverse side of the channel arm. When the vacuum cups are out of abutting relationship with a case blank, screw 81 retains arm 82 throughout its length in spaced relationship to the upper floater plate and the lower surface of arm 82 in abutting relationship to the lower floater plate. However due to the somewhat enlarged apertures in the floater plates through which the bolts 87 extend and the provision of springs 89, the lower plate 88 can move a limited amount relative the upper plate including pivoting about transverse and longitudinal axes. Thus, when arms 82, 93 are lowered to move the cups into abutting relationship with a stack of case blanks and one part of the uppermost blank is higher than the remainder thereof, the arms can pivot (tilt) a limited amount about transverse and longitudinal axes as the cups are moved into abutting relationship with the uppermost blank.

In order to longitudinally reciprocate the carriage C from the rearward case blank pickup position to a position to transfer or feed the picked up case blank to the belt conveyor assembly, there is provided a piston-cylinder combination 95, 96 that has a piston rod 95 pivotally connected at 97 to the guide shaft mount 85. The cylinder 96 is pivotally connected at 99 to the mount 98 which in turn is mounted on the mounting plate 54.

Provided on transverse opposite sides of the side frames 58 are longitudinally elongated vertical guide plates 72. The guide plates are mounted in transverse adjusted positions by clamp mechanisms 73 which in turn are mounted on the lower rails 53 such that the guide plates extend upwardly of the lower rails.

The trolley feed assembly 14 includes a longitudinally elongated track 104 that at one end is mounted by a bracket (not shown), the bracket being mounted on a transverse frame member 108. The frame member 108 is mounted by uprights 18 at a lower elevation than frame member 47. The opposite end of the track is supported by structure (not shown). Mounted on the track for longitudinal reciprocal movement is a carriage or trolley T, the carriage including a carriage member 103. The carriage member mounts a plurality of wheels 102 for bearing against horizontal surfaces of the track and wheels 101 to bear against verical surfaces of the track in a conventional manner. Also on the carriage member 103 is a horizontal plate 109 that is retained longitudinally adjusted positions on member 103. A pusher member 105 has a forwardly and upwardly opening rectangular cutout 107, a horizontal plate 106 being mounted on the pusher member to extend above the cutout. The pusher member is mounted on plate 109.

In order to move the carriage T between its rearwardmost position to engage a folded case blank B and its forwardmost position to deliver (push) the foled case blank to other conventional apparatus for opening and forming the case blank, a drive link 110 at one end is pivotally connected to the carriage member 103 and at its opposite end is pivotally connected to a chain 111. The chain is extended around an idler sprocket 112 and a drive sprocket 113. The idler sprocket is rotatably mounted on a longitudinally elongated plate 115 while the drive sprocket is keyed to a drive shaft 114 that in turn is rotatably mounted by plate 115. Plate 115 at one end is mounted by a bracket 117 that in turn is mounted by frame member 116. A conventional drive connection 119 is provided between the drive sprocket on drive shaft 114 and the motor 120 that is mounted on the frame.

In order to support a case blank after it has been discharged from the conveyor belt feeder assembly 13 and until it has been moved by the carriage T into conventional opening and forming mechanism (not shown), there is provided a longitudinally elongated slide rail 122 on either transverse side of the track 104. The slide rails at one end are mounted by brackets 123, the brackets in turn being mounted by transverse frame member 47. The opposite ends of the slide rails are mounted by an appropriate support (not shown). The upper edges of the slide rails are at approximately the same elevation as the horizontal surface of the pusher member that in part defines cutout 107.

Above and rearwardly of the drive shaft 114, there is provided a transverse rail 126, the rail at its opposite end being mounted by a mount 127. The mounts 127 are mounted on the longitudinal frame members 48 and are of a construction to be adjustably positioned along the length thereof and clamplingly engage the frame members to retain the rail 126 in a longitudinal adjusted position. Transversely spaced upwardly and rearwardly inclined guide plate 129 have their forward ends mounted by mounts 130 which in turn are mounted by rail 126 to be transversely positioned along the length thereof and retained in the adjusted positions. The plates 129 at their rearward ends extend to a higher elevation than the lower run of belt 61 while the forward ends of the plates are at a slightly higher elevation than the upper edges of the slide rails 122 in order to permit a case blank being slid along the slide rails and beneath the guide plates 129. Thus, the guide plates 129 serve to direct the leading edge portion of the folded case blank downwardly in a forward direction as the case blank is discharged by the conveyor belt assembly 13. In order to prevent the case blank moving transversely out of appropriate alignment as it is discharged to fall onto slide rails, there is provided a pair of transversely spaced vertical guide plates 132. The forward end portion of each guide plate is mounted by a bracket 133 that in turn is mounted on rail 126 to be adjustably positioned along the transverse length thereof and retained in the adjusted position.

Figures 4, 5:
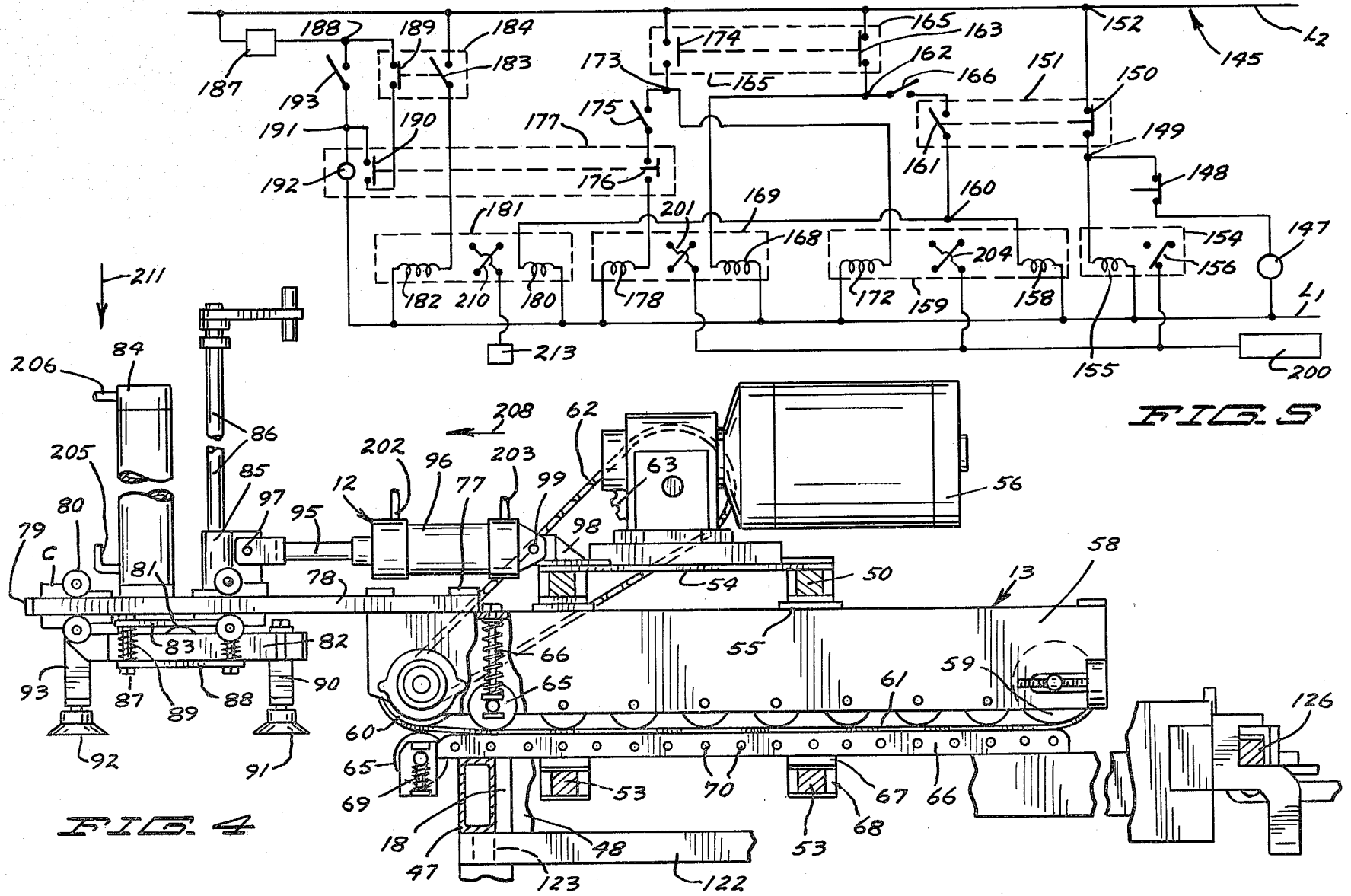
FIG. 4 is an enlarged fragmentary side elevational view of part of the apparatus of FIG. 3, various parts being broken away.
FIG. 5 is a schematic showing of the electrical and pneumatic circuitry for the apparatus of this invention.

Referring now to FIG. 5, the control circuitry, generally designated 145, includes main power lines $L_1$ and $L_2$. Connected in series across line $L_1$ and junction 149 is an on/off switch 148 that remains in the position that it is set in and the motor 147 for driving the magazine belt. A switch member 150 of limit switch 151 is connected across junction 149 and a junction 152 on line $L_2$, while the solenoid coil 155 of solenoid operated pneumatic valve 154 is connected across junction 149 and line $L_1$. A solenoid coil 158 of the pneumatic control valve 159 is connected across line $L_1$ and junction 160, valve 159 controlling the application of fluid under pressure to the cylinder 84 for elevating and lower the vacuum cups. A second switch member 161 of limit switch 151 and a limit switch 166 are connected in series across junctions 160, 162 while a switch member 163 of vacuum switch 165 is connected across junction 162 and line $L_2$. Connected across junction 162 and line $L_1$ is a solenoid coil 168 of a pneumatic control valve 169, valve 169 controlling the application of fluid under pressure to cylinder 96 for moving the vacuum cup carriage between its forward-most and rearward-most positions.

Vacuum switch 165 includes a second switch member 174 that is connected across line $L_2$ and junction 173, a solenoid coil 172 of valve 159 being connected across junction 173 and line $L_1$. Connected in series across junction 173 and line $L_1$ is a limit switch 175, switch member 176 of the solenoid operated relay 177, and the solenoid coil 178 of pneumatic valve 169.

Connected in series across junction 160 and line $L_1$ is a solenoid coil 180 of the pneumatic control valve 181 which controls the application of a vacuum to the vacuum cups 91, 92. Valve 181 includes a second solenoids coil 182 which is connected in series with a switch member 183 of a limit switch 184, coil 182 and switch member 183 being connected in series across lines $L_1$ and $L_2$. A second switch member switch 184, and a switch member 190 of relay 177 are connected in series across junction 191 and a junction 188 while the solenoid coil 192 of relay 177 is connected across junction 191 and line $L_1$. A switch member 193 operated to a closed position for a short period of time during every cycle by the conventional case opening part of the machine (which does not form part of this invention) is connected across junctions 188, 191. Connected across junction 188 and line $L_2$ is the control circuitry 187 of the case opener part of the machine which does not form part of this invention.

For purposes of facilitating the description of the operation of the apparatus of this invention, it will be assumed that the vacuum cups are in their elevated position and the vacuum cup carriage is in its forward-most position of FIG. 1A while the first stack of flat folded case blanks F is rearwardly of that shown in FIG. 1A. Since switch member 150 is resiliently retained in an open condition and switch member 161 in a closed condition, when no case blank on belt 26 abuts against the stop plate 34 and upon applying power across lines $L_1$, $L_2$, coil 155 is energized to move valve member 156 of valve 154 to apply fluid under pressure from source 200 to the lower end of case hold down cylinder 41. This raises pad 43, the pad being resiliently urged in a downward direction. At the same time a brush pneumatic control valve (not shown), that is of the same construction as valve 159, has one of its solenoid coils (connected across junction 149 and line $L_2$) energized to apply air under pressure to the adjacent ends of lbrush cylinders 37 to move the brushes away from one another. Further, at this time motor 147 is energized to drive belt 26 to advance stack F until it abuts against stop plate 34 and at the same time operate switch 151 to open switch member 150 and close switch member 161. Opening switch member 150 denergizes motor 147 and coil 155 whereby the lower end of the hold down cylinder is fluidly connected to the exhaust port of valve 154. Pad 43 is resiliently moved to abut against the top blank on stack S. At the same time switch member 150 opens a switch member (not shown), connected in series with the second coil of the brush valve across lines $L_1$, $L_2$, is closed by stack F moving to abut against the stop plate whereby the valve member of the brush valve is moved to fluidly connect the adjacent ends of cylinders 37 to an exhaust port and apply fluid under pressure from the source to the cylinder remote ends to move the brushes from their retracted positions to positions to abut against opposite sides of stack F.

At the same time power was applied to lines $L_1$, $L_2$, switch member 163 of the vacuum limit switch, was in a closed condition as no vacuum was being applied to the cups and accordingly pneumatic valve solenoid 168 was energized. This operates the valve member 201 for applying fluid under pressure from the valve inlet port to line 203 of cylinder 96 and exhausting fluid through line 202. As a result, the piston rod 95 is moved in the direction of the arrow 208 and accordingly the vaccum cup carriage is moved in the same direction. Upon the vacuum cup carriage being moved to its rearwardmost position, it engages limit switch 166 to move it to a closed position, limit switch 164 being resiliently retained in an open condition.

Upon limit switch 166 closing and with switch member 161 being in a closed condition, or upon being closed, solenoid coil 180 is energized for moving its valve member 210 to a position that the inlet port of valve 181 is fluidly connected for applying a vacuum to the vacuum cups 91, 92. The inlet port of valve 181 is connected to a source of vacuum 213. At the same time, solenoid coil 158 of valve 159 is energized to move its valve 204 to a position for fluidly connecting the inlet port of valve 159 for applying fluid under pressure to line 206 of cylinder 84 and connecting line 205 of said cylinder to the exhaust. As a result, the piston rod of cylinder 84 moves the floater plate 83 and the structure connected thereto in a downward direction. Upon the vacuum cups 91, 92 forming a gripping engagement with the uppermost blank B on the stack F, vacuum switch 165 is operated by the decrease in pressure to move its switch member 163 to an open condition whereby solenoid coils 180, 158, and 168 are deenergized.

At the same time that switch member 163 moved to an open condition, switch member 174 moved to a closed condition. This energies solenoid coil 172 which operates valve member 204 to fluidly connect the inlet port of the valve 159 to line 205 and line 206 to the exhaust. As a result, the piston rod of cylinder 84 moves the floater plate 83 and the structure thereon in a direction opposite arrow 211 to remove a case blank from stack F. Upon the floater plate being moved to its uppermost position, it engages limit switch 175 to move it to a closed condition, limit switch 175 being resiliently retained in an open condition.

If at this time the case opener part of the machine has not completed its cycle of operation, relay 177 will be deenergized and accordingly switch members 176, 190 will be opened. However, upon the case opener portion completing its cycle of operation, it will close limit switch 193 which completes the circuitry for energizing relay coil 192. Upon coil 192 being energized, switch members 190, 176 are moved to a closed condition, switch member 176 in closing completing a circuit for energizing coil 178 of valve 169. This operates a valve member 201 to a position for applying fluid under pressure to line 202 and connecting line 203 to the exhaust. As a result piston rod 95 is moved in a direction opposite arrow 208 whereby the vacuum cup carriage is moved to its forward-most position. As the vacuum cup carriage is moved to its forward-most position, the leading edge portion of the case blank being grippingly engaged by the cups, is moved into the entry nip between lead roller 65 and belt 61, belt 61 being continuously driven. Upon the vacuum cup carriage being moved to its forward-most position it engages the operator of limit switch 184 for moving switch member 183 to a closed position and switch member 189 to its open position, switch 184 being of a construction that switch member 183 is resiliently retained in a open condition and switch member 189 in a closed condition. Switch member 183 in moving to a closed condition completes a circuit to energize coil 182 whereby valve member 210 of valve 181 is moved to a position for discontinuing the application of vacuum from source 213 to the cups and permitting ambient air flowing into the cups whereby the gripping engagement with the case blank is released. The movement of the carriage C in a forward direction and the release of the vacuum at the vacuum cups is timed so that the transfer of the case from the cups to the belt conveyor assembly results in a continuous forward movement of the picked up case.

Prior to the time the vacuum cup carriage has ben moved to its forward-most position, switch 193 has been resiliently retained to its open condition. At the time the vacuum cup carriage moves to operate switch 184 to move switch member 189 to its open condition, the hold in circuitry for the relay 177 is broken and as a result the relay is deenergized. This results in switch members 176, 190 moving to their open positions. Switch member 176 in moving to its open position results in coil 178 of valve 169 being deenergized.

Upon the discontinuance of the application of vacuum to the vacuum cups, due to the movement of valve member 210 resulting from energization of coil 182, vacuum switch member 174 resiliently returns to its open position and switch member 163 to its closed condition. This results in coil 172 of valve 159 being deenergized and coil 168 of valve 169 being energized to move the carriage C rearwardly and a cycle of operation started for removing another case blank.

Once the picked up folded case blank has entered into the entry nip between lead roller 65 and belt 61, the case blank continues to move forwardly due to the belt 61 being continuously driven. The case blank being moved in advance of the idler roller 59 either under gravity or upon being moved into abutting engagement with the guide plates 129, is directed downwardly toward the slide rails 122. Upon the case blank being completely discharged by the belt conveyor assembly, the blank is completely supported by the slide rails. At this time the trailing edge thereof is located forwardly of the pusher member 105. Now the pusher member is moved forwardly such that the trailing edge portion of the blank is located in the cutout 107 and the blank is moved forwardly into the bag opening portion of the machine to be opened in a conventional manner.

By using the apparatus of this invention, only one case at a time is picked up and moved to a position to be fed by the trolley carriage assembly T into the case opening portion of the machine.

The pickup assembly, the magazine assembly and belt conveyor assembly are mounted on a conventional blank opener and forming machine, device 52 being mounted on the frame of the conventional machine. Further the frame members 21, 24 are mounted on the conventional machine. By providing the belt conveyor assembly, one blank may be advanced while the vacuum cups are being returned to pick up another blank, the lowering of the cups being delayed until the trailing edge of the blank being conveyed by the belt conveyor assembly has moved in advance of the front vacuum cups in their rearward blank pickup position.

Each of valves 159, 169 and 181 is of a type that when one of its solenoid coils is energized the valve member moves to the position to make the fluid connections indicated (if not already in such a position), and remains in the position it has moved to until the other solenoid coil is energized.

What is claimed is:

1. For removing a case blank having an upper and a lower surface from a stack of case blanks in flat folded conditions and advancing a case blank, a main frame, longitudinally elongated slide means mounted on the main frame for supporting a flat folded case blank as it is advanced, first carriage means mounted on the main frame for reciprocal movement between a first position and a second position longitudinally forward of the first position for advancing a case blank along the slide means, conveyor means on the frame for advancing a flat folded case blank from a transfer position and discharging the case blank onto the slide means in a position to be advanced along the slide means by movement of the first carriage means from its first position to its second position, and a vacuum pickup assembly mounted on the main frame for removing a case blank from the stack of case blanks and moving the case blank to the transfer position to transfer the picked up case blank to the conveyor means, the conveyor means including a continuous belt having a longitudinally elongated inner run for conveyingly abutting against one of said surfaces, a conveyor frame, means mounted on the conveyor frame for mounting and driving the belt, and longitudinally spaced means for abutting against the other of said surfaces of the blank abutting against the inner run, the belt inner run being at a higher elevation than the means for abutting against the other of said surfaces.

2. The apparatus of claim 1 further characterized in that the belt inner run is at a higher elevation than said slide means and that there is provided guide means for directing a case blank downwardly onto the slide means as the case blank is moved in advance of the belt inner run.

3. The apparatus of claim 1 further characterized in that the means for mounting the belt includes means abutting against the inner run to resiliently retain it in abutting relationship with the means for abutting against the other surface when there is no case blank therebetween.

4. For removing a case blank from a stack of case blanks in flat folded conditions and advancing a case blank, a main frame that includes a carriage track, longitudinally elongated slide means mounted on the frame for supporting a flat folded case blank as it is advanced, first carriage means mounted on the frame for reciprocal movement between a first position and a second position longitudinally forward of the first position for advancing a case blank along the slide means, conveyor means on the frame for advancing a flat folded case blank from a transfer position and discharging the case blank onto the slide means in a position to be advanced along the slide means by movement of the first carriage means from its first position to its second position, and a vacuum pickup assembly mounted on the frame for removing a case blank from the stack of case blanks and moving the case blank to the transfer position to transfer the picked up case blank to the conveyor means, the vacuum pickup means including a second carriage mounted on the track for movement between a case blank pickup first position and a case blank transfer second position, means mounted on the frame for moving the second carriage between its positions, vacuum cup means for grippingly engaging a case blank, and means mounted on the second carriage for movement therewith for moving the vacuum cup means between the first position adjacent the second carriage and a second position more remote from the second carriage to pick up a case blank from the stack when the second carriage is in its case blank pickup position, and the conveyor means comprising belt conveyor means for receiving the picked up case blank and discharging the picked up case blank.

5. The apparatus of claim 4 further characterized in that there is provided control means for automatically operating the vacuum cup means moving means for moving the vacuum cup means from its first position to its second position when the second carriage is in its first position, and after the vacuum cup means has grippingly engaged a case blank on the stack, move the vacuum cup means from its second position to its first position.

6. The apparatus of claim 5 further characterized in that the vacuum cup means includes a vacuum cup and that the control means includes means for applying a vacuum to the vacuum cup when the second carriage moves from its second position to its first position and discontinue the application of a vacuum when the second carriage has moved to its second position.

7. The apparatus of claim 4 further characterized in that the vacuum cup means includes a first and a second vacuum cup, and that the means for moving the vacuum cup means includes arm means for mounting the vacuum cups, a floater plate, piston cylinder means mounted on the second carriage for mounting the floater plate and moving the floater plate relative the second carriage between the vacuum cup means first and second positions and means for mounting the arm means on the floater plate for limited movement relative the floater plate.

8. The apparatus of claim 7 further characterized in that the belt conveyor means includes a longitudinally elongated conveyor frame, means for mounting the conveyor frame on the main frame, a plurality of longitudinally spaced, transverse rollers rotatably mounted on the conveyor frame, an endless belt having an inner run, and means for mounting the belt with the inner run adjacent the rollers and driving the belt to advance a case blank that extends between the inner run and the rollers.

9. The apparatus of claim 8 further characterized in that there is provided a case magazine for supporting the stack of folded case blanks in vertical stacked relationship at a location beneath the second carriage in its first position, that the belt inner run is above the rollers and at a higher elevation than the slide means, and that there is provided guide means on the frame for directing a case blank downwardly onto the slide means as the case blank is moved in advance of the belt inner run.

10. The apparatus of claim 7 further characterized in that there is provided a case magazine on the frame for supporting the stack of folded case blanks in vertical stacked relationship with one blank above another in a position to have the uppermost blank on the stack removed by the vacuum pickup assembly, and vertical elongated brush means mounted on the frame on opposite sides of the stack for abutting against the stack on the magazine and retaining the blanks other than the uppermost blank in the stacked relationship as the uppermost blank is being removed.

11. The apparatus of claim 10 further characterized in that the brush means includes a vertically elongated brush having bristles for abutting against the adjacent side of the stack, and power operated means mounted on the frame for mounting the brush and moving the brush between a retracted position and a stack engaging position.

12. Case blank pickup and feeder apparatus comprising a frame, magazine means on the frame for supporting vertical stacks of case blanks in horizontal flat folded conditions, the magazine means including an endless belt for supporting a plurality of vertical stacks on case blanks including in a first stack position and in an adjacent second stack position, means for mounting the belt on the frame and operable for moving the stack in the second stack position to the first stack position when there are no blanks in the first stack position, vacuum means on the frame for grippingly engaging the uppermost case blank on the stack in the first stack position, vertically removing the case from the stack and moving the engaged case blank to a transfer position, vertically elongated brush means mounted on the frame for abutting against the stack in the first stack position to retain the case in the stack, other than the gripped blank, in proper stacked relationship as the gripped case is removed, conveyor means for receiving the gripped case blank at the transfer position and advancing the case blank in a flat folded condition, the brush means including a pair of vertically elongated brushes, the brushes being located on opposite sides of the stack in the first stack position, and operable power means mounted on the frame for mounting and moving the brushes between retracted positions and stack engaging positions, and control means operating the power means to move the brushes to their retracted positions when there are no case blanks at the first stack position, then belt moving means to move the belt to move a stack to the first stack position and then the power means to move the brushes to their stack engaging positions.

13. Case blank pickup and feeder apparatus comprising a frame, magazine means on the frame for supporting a stack of flat folded case blanks, a plurality of vacuum cups for grippingly engaging a blank on the stack, arm means for mounting the cups in spaced relationship, said arms means having opposite elongated first and second surfaces, a first floater plate for abutting against the first surface, a second plate, resilient means for connecting the floater plates to one another with said surfaces extending between the plates, permitting limited movement of the plates relative one another and resiliently urging the plates away from one another, a pivot member mounted on one of the second plates and arm means in abutting relationship to the other to retain the second plate spaced from the arm means when the cups are out of gripping relationship to a case blank and permit limited movement of the arm means relative at least one of the floater plates, power operated means on the frame and attached to one of the floater plates for moving the one of the floater plates between a case blank pickup position and a transfer position and conveyor means on the frame for conveyingly engaging a case blank grippingly engaged by the cups and being moved to the transfer position to move the blank in advance of the cups in a flat folded condition.

14. The apparatus of claim 13 further characterized in that there is provided slide means for receiving a flat folded case blank from the conveyor means, and carriage means for pushing a folded case blank on the slide means along the slide means.

15. For removing the uppermost case blank from a vertical stack of case blanks in horizontal, flat folded conditions and advancing the removed case blank, a main frame, a belt conveyor assembly on the frame for receiving a folded case blank at a blank transfer position, advancing the received case blank, and discharging the case blank longitudinally forwardly of the transfer position, means mounted on the frame for receiving the folded case blank from the belt conveyor assembly and further advancing the case blank in a folded condition, and means for picking up the uppermost case blank on the stack and moving the picked up case blank to the transfer position to transfer the case blank to the belt conveyor assembly, the means for picking up a case blank comprising vacuum cup means for grippingly engaging a case blank on the stack and means for moving the vacuum cup means between a position to pick up a case blank from the stack of case blanks and a position to transfer the picked up case blank to the belt conveyor assembly, the means for moving the vacuum cup means comprising a carriage mounted on the frame for reciprocal movement between a case blank pickup position and a case blank transfer position, power means on the frame for moving the carriage between its positions, and means mounted on the carriage for mounting the vacuum cup means, the vacuum cup means comprises a plurality of vacuum cups, arm means for mounting the vacuum cups in spaced relationshp, said arm means having opposite upper and lower surfaces, a pivot member connected to the arm means and extending above the upper surface, and the means mounted on the carriage including an upper floater plate, power operated means mounted on the carriage for moving the upper floater plate toward and away from the carriage, a lower floater plate, and means for connecting the floater plates together, retaining the lower floater plate in abutting relationship to the lower surface and the upper floater plate in abutting relationship to the pivot member and resisiently urging the floater plates away from one another and the upper plate away from the upper surface.

* * * * *